US007093624B2

(12) United States Patent
Chen

(10) Patent No.: US 7,093,624 B2
(45) Date of Patent: Aug. 22, 2006

(54) LIQUID PUMPING DEVICE

(75) Inventor: Chi-Liang Chen, Tainan Hsien (TW)
(73) Assignee: Yo Lee Manufacturing Inc., An Ding Hsiang (TW)

( * ) Notice: Subject to any disclaimer, the term of this patent is extended or adjusted under 35 U.S.C. 154(b) by 177 days.

(21) Appl. No.: 10/914,316

(22) Filed: Aug. 9, 2004

(65) Prior Publication Data

US 2006/0027608 A1 Feb. 9, 2006

(51) Int. Cl.
*B65B 31/04* (2006.01)

(52) U.S. Cl. ..... 141/65; 141/27; 141/59; 141/302; 137/205; 184/1.5; 417/118; 417/148

(58) Field of Classification Search ..... 141/27, 141/54, 59, 65, 301, 302; 137/205, 365; 417/118, 148, 199.1; 184/1.5
See application file for complete search history.

(56) References Cited

U.S. PATENT DOCUMENTS 5,450,924 A * 9/1995 Tseng ..... 184/1.5
6,722,855 B1 * 4/2004 Tien-Tsai ..... 417/199.1

* cited by examiner

*Primary Examiner*—Timothy L. Maust
(74) *Attorney, Agent, or Firm*—Alan D. Kamrath; Nikolai & Mersereau, P.A.

(57) ABSTRACT

A liquid pumping device includes a barrel, a cylinder, a conducting rod, a piston, an operation lever, and a cover. Thus, the liquid pumping device is operated automatically by the power source or operated manually by the operation lever to suck the liquid from the suction pipe into the inside of the barrel rapidly, so that the liquid pumping device is operated automatically and manually, thereby greatly enhancing the versatility of the liquid pumping device.

14 Claims, 7 Drawing Sheets

LIQUID PUMPING DEVICE

BACKGROUND OF THE INVENTION

1. Field of the Invention

The present invention relates to a liquid pumping device, and more particularly to a liquid pumping device that is operated automatically and manually, thereby enhancing the versatility of the liquid pumping device.

2. Description of the Related Art

A conventional liquid pumping device comprises a cylinder, a suction pipe connected to the cylinder, a piston movably mounted in the cylinder, a movable rod movably mounted in the cylinder and having a lower end secured to the piston to push the piston, and a press lever mounted on the movable rod to move the movable rod. Thus, the press lever is pulled upward and pushed downward to move the piston in the cylinder reciprocally, thereby forming a vacuum suction in the inside of the cylinder so as to suck a liquid, such as the oil or the like, from the suction pipe into the inside of the cylinder. However, the conventional liquid pumping device is operated manually by press lever to suck the liquid from the suction pipe into the inside of the cylinder, thereby wasting the manual work and the working time.

SUMMARY OF THE INVENTION

In accordance with the present invention, there is provided a liquid pumping device, comprising:

a barrel;

a cylinder mounted in the barrel;

a conducting rod movably mounted in the cylinder and having an upper end protruding outward from the barrel, an inside formed with a conducting hole and a lower end provided with a oneway valve to allow fluid in the cylinder to flow upward into the conducting hole only;

a piston movably mounted in the cylinder and secured on the lower end of the conducting rod to move therewith, the piston having a peripheral wall formed with a plurality of oneway valves to allow fluid in an upper portion of the cylinder to flow downward into a lower portion of the cylinder only; and an operation lever secured on the upper end of the conducting rod and having an inside formed with an air channel, the air channel of the operation lever having a mediate portion formed with a reduced neck provided with a pressure release valve having an inside formed with a valve hole communicating with the air channel of the operation lever and the conducting hole of the conducting rod.

The primary objective of the present invention is to provide a liquid pumping device that is operated automatically and manually, thereby greatly enhancing the versatility of the liquid pumping device.

Another objective of the present invention is to provide a liquid pumping device that is operated automatically by the power source to suck the liquid from the suction pipe into the inside of the barrel rapidly.

A further objective of the present invention is to provide a liquid pumping device that is operated manually by the operation lever to suck the liquid from the suction pipe into the inside of the barrel rapidly.

Further benefits and advantages of the present invention will become apparent after a careful reading of the detailed description with appropriate reference to the accompanying drawings.

DETAILED DESCRIPTION OF THE INVENTION

Figure 1:
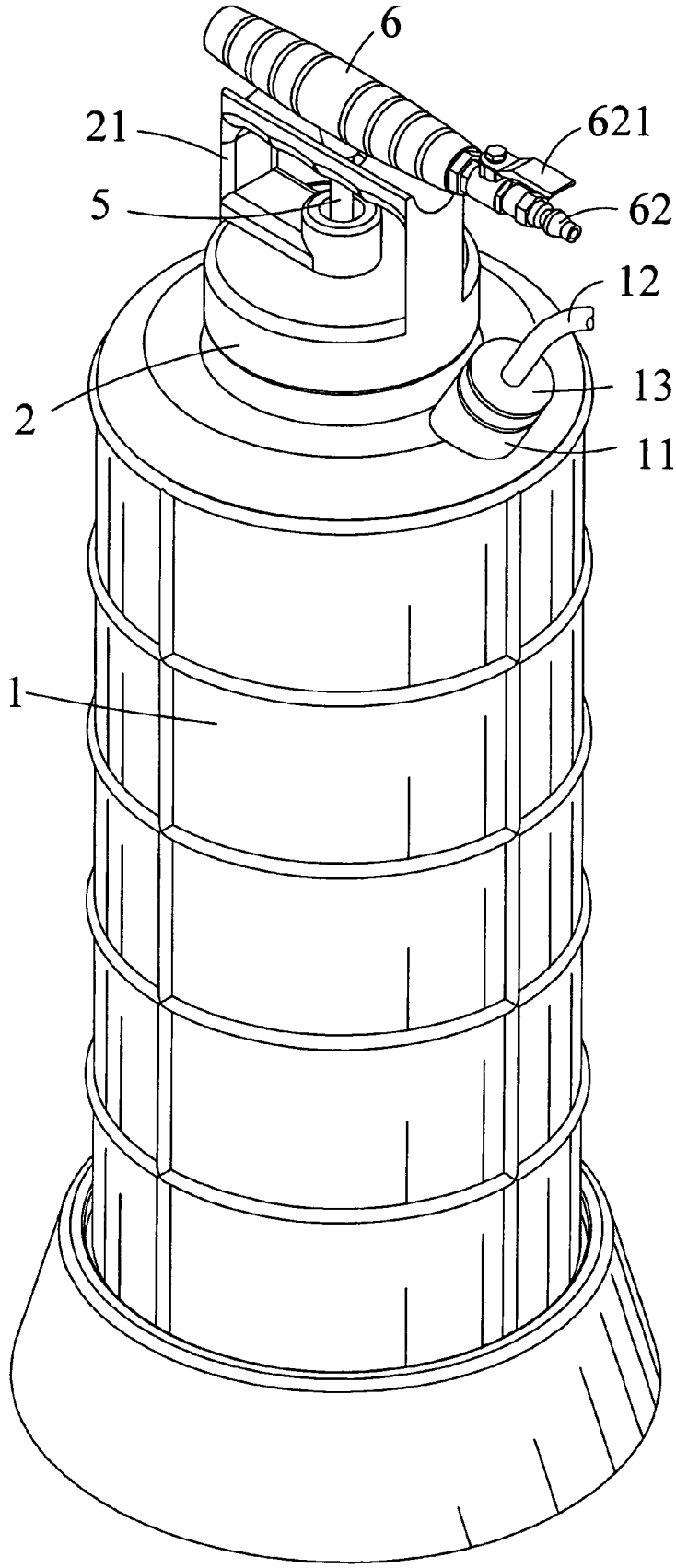
FIG. 1 is a perspective view of a liquid pumping device in accordance with the preferred embodiment of the present invention.
Figure 2:
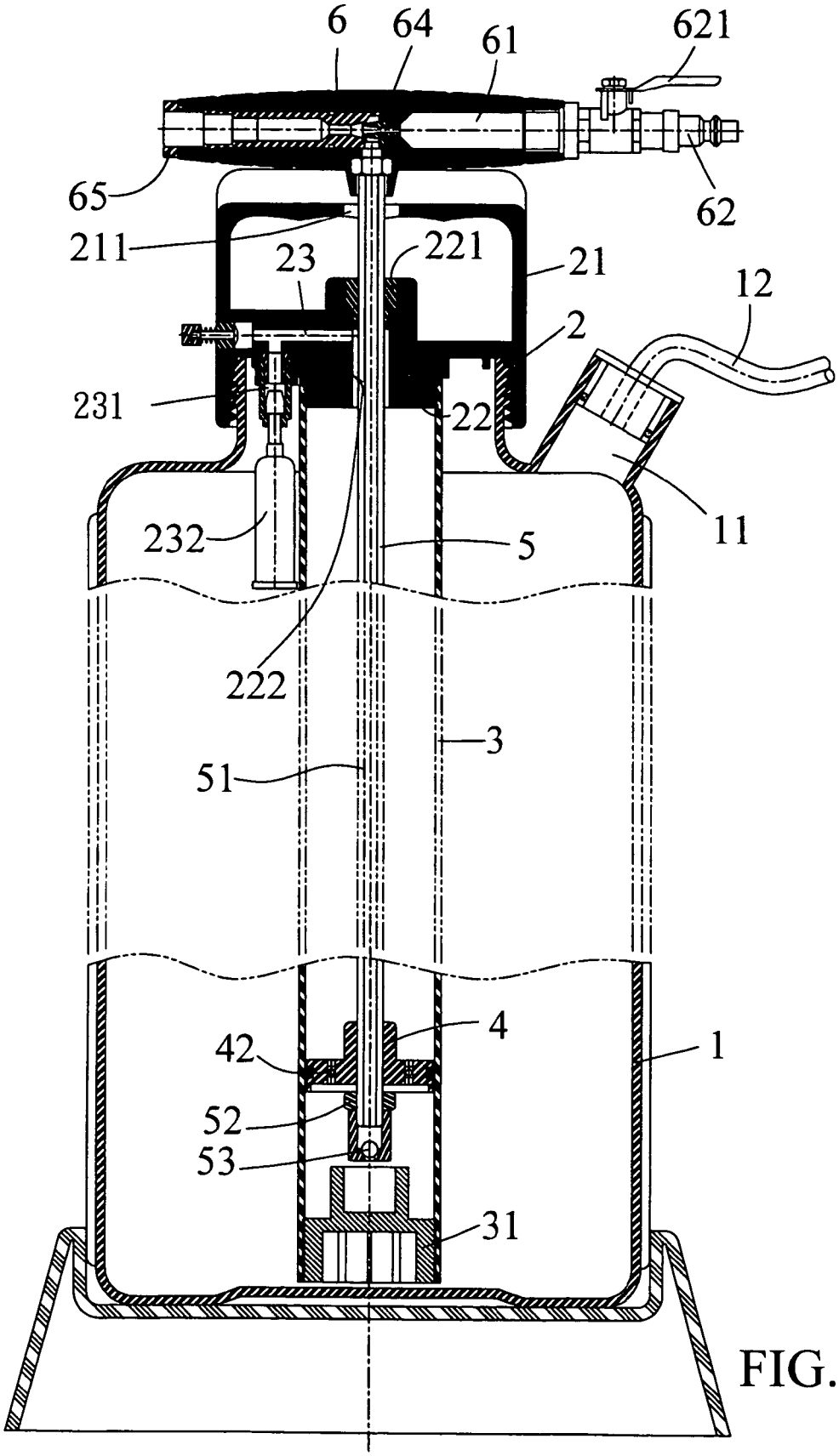
FIG. 2 is a partially cut-away plan cross-sectional view of the liquid pumping device as shown in FIG. 1.
Figure 3:
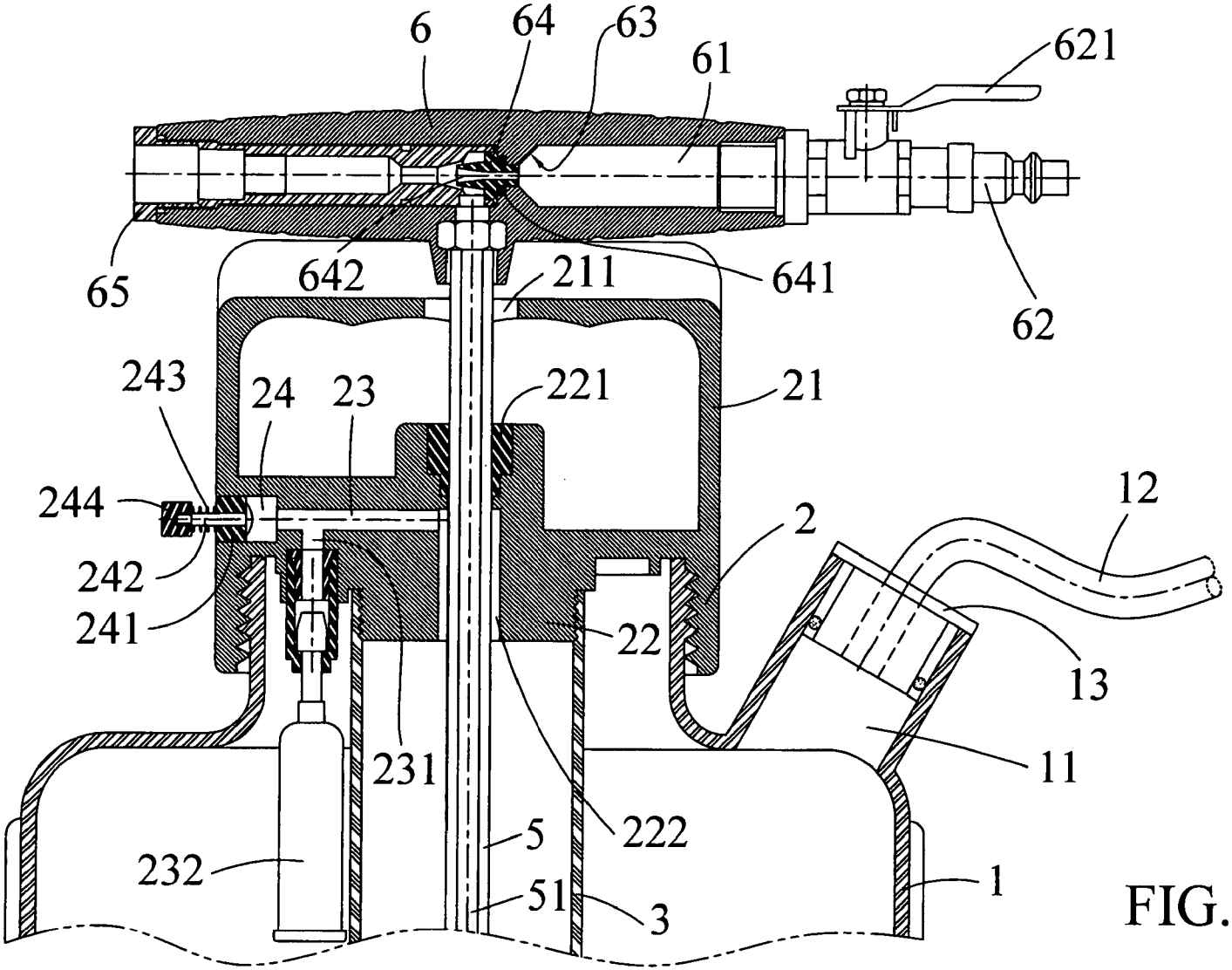
FIG. 3 is a partially enlarged view of the liquid pumping device as shown in FIG. 2.
Figure 4:
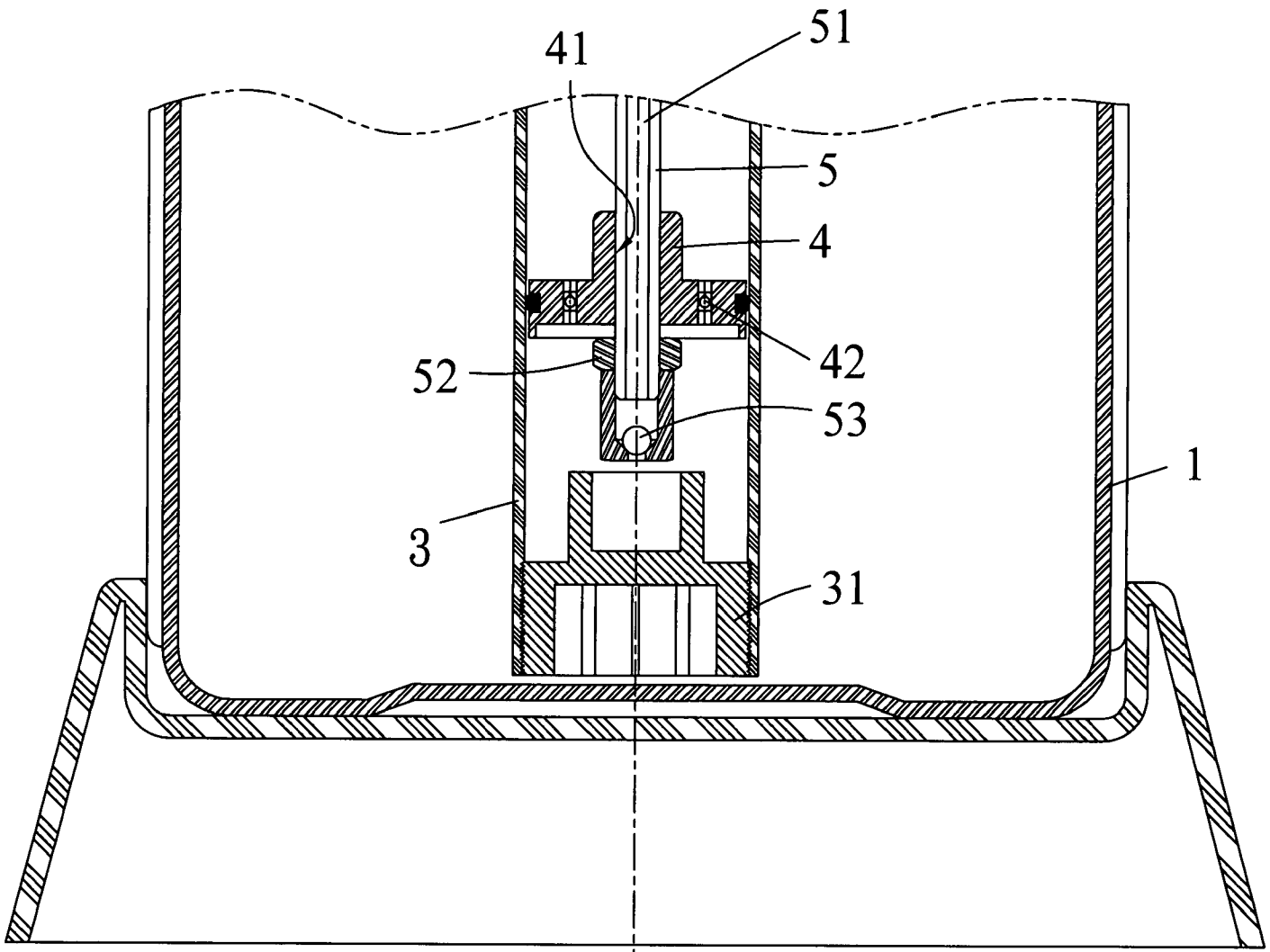
FIG. 4 is a partially enlarged view of the liquid pumping device as shown in FIG. 2.
Figure 5:
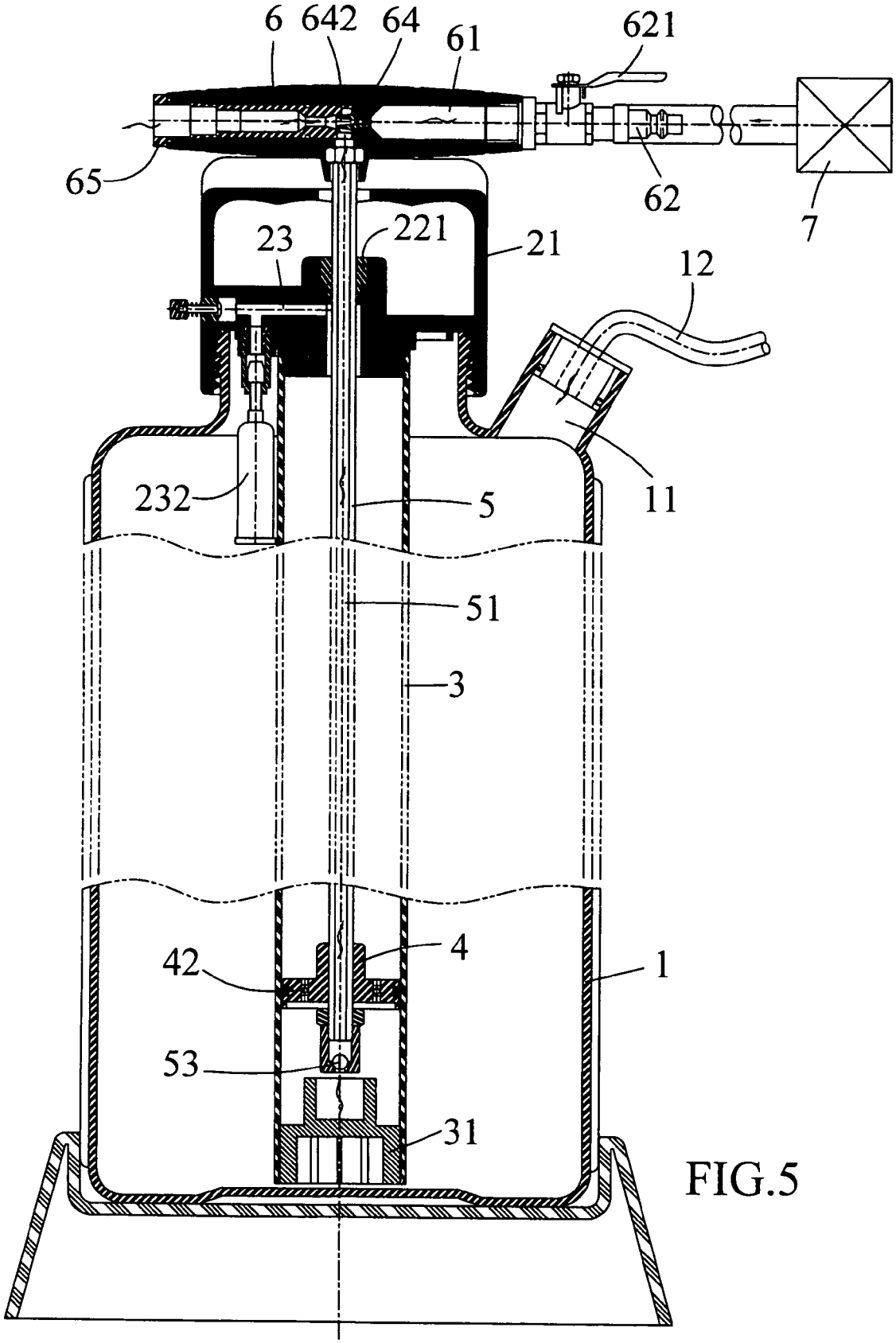
FIG. 5 is a schematic operational view of the liquid pumping device as shown in FIG. 2.

Referring to the drawings and initially to FIGS. 1–4, a liquid pumping device in accordance with the preferred embodiment of the present invention comprises a barrel 1, a cylinder 3, a conducting rod 5, a piston 4, an operation lever 6, and a cover 2.

The barrel 1 has a top formed with a suction hole 11 for mounting a suction pipe 12 which is mounted in the suction hole 11 of the barrel 1 by a seal 13.

The cylinder 3 is mounted in the barrel 1. A sealing ring 31 is mounted on a lower end of the cylinder 3.

The conducting rod 5 is movably mounted in the cylinder 3 and has an upper end protruding outward from the barrel 1. The conducting rod 5 has an inside formed with a conducting hole 51 and has a lower end provided with a oneway valve 53 to allow fluid in the cylinder 3 to flow upward into the conducting hole 51 only.

The piston 4 is movably mounted in the cylinder 3 and is secured on the lower end of the conducting rod 5 to move therewith. The piston 4 has a peripheral wall formed with a plurality of oneway valves 42 to allow fluid in an upper portion of the cylinder 3 to flow downward into a lower portion of the cylinder 3 only. The piston 4 is formed with a through hole 41 mounted on the lower end of the conducting rod 5. A nut 52 is screwed onto the lower end of the conducting rod 5 and rested on the piston 4.

The operation lever 6 is secured on the upper end of the conducting rod 5 and has an inside formed with an air channel 61. The air channel 61 of the operation lever 6 has a mediate portion formed with a reduced neck 63 provided with a pressure release valve 64 having an inside formed with a valve hole 642 communicating with the air channel 61 of the operation lever 6 and the conducting hole 51 of the conducting rod 5. The valve hole 642 of the pressure release valve 64 has a dimension smaller than that of the air channel 61 of the operation lever 6 and has a narrower first end and a wider second portion. An urging ring 641 is mounted between the pressure release valve 64 and the reduced neck 63 of the operation lever 6. The air channel 61 of the operation lever 6 has a first end provided with an air inlet nozzle 62 and a control switch 621 and a second end provided with a muffler 65.

The cover 2 is mounted on the top of the barrel 1 and has a first end face formed with a handle 21 formed with a through hole 211 to allow passage of the conducting rod 5 and a second end face formed with a lug 22 inserted into an upper end of the cylinder 3. The lug 22 of the cover 2 has an inside formed with a conducting channel 222 mounted on the conducting rod 5 and connected to the inside of the cylinder 3. A mounting ring 221 is mounted between the lug 22 of the cover 2 and the conducting rod 5. The cover 2 has a side formed with a conducting groove 23 having a first end connected to the conducting channel 222 of the lug 22 and a second end formed with an insertion recess 24 for mounting a fixing ring 241. An operation shaft 242 is movably mounted on the fixing ring 241 and has a first end rested on the fixing ring 241 and a second end protruding outward from the fixing ring 241. An adjusting knob 244 is secured on the second end of the operation shaft 242. An elastic member 243 is mounted on the operation shaft 242 and biased between the fixing ring 241 and the adjusting knob 244. The conducting groove 23 of the cover 2 has a mediate portion formed with a through hole 231 connected to the inside of the barrel 1 and provided with a float 232.

In operation, referring to FIGS. 1–5, the air inlet nozzle 62 of the operation lever 6 is connected to a power source 7 which introduces air into the air channel 61 of the operation lever 6. When the air passes through the pressure release valve 64 of the operation lever 6, the valve hole 642 of the pressure release valve 64 has a dimension smaller than that of the air channel 61 of the operation lever 6, so that the velocity at the pressure release valve 64 is increased to decrease the pressure, thereby forming a pressure differential to extract the air contained in the conducting hole 51 of the conducting rod 5 outward from the air channel 61 of the operation lever 6 to evacuate the inside of the barrel 1, thereby forming a suction force in the inside of the barrel 1 to suck liquid from the suction pipe 12 into the inside of the barrel 1 rapidly.

Figure 6:
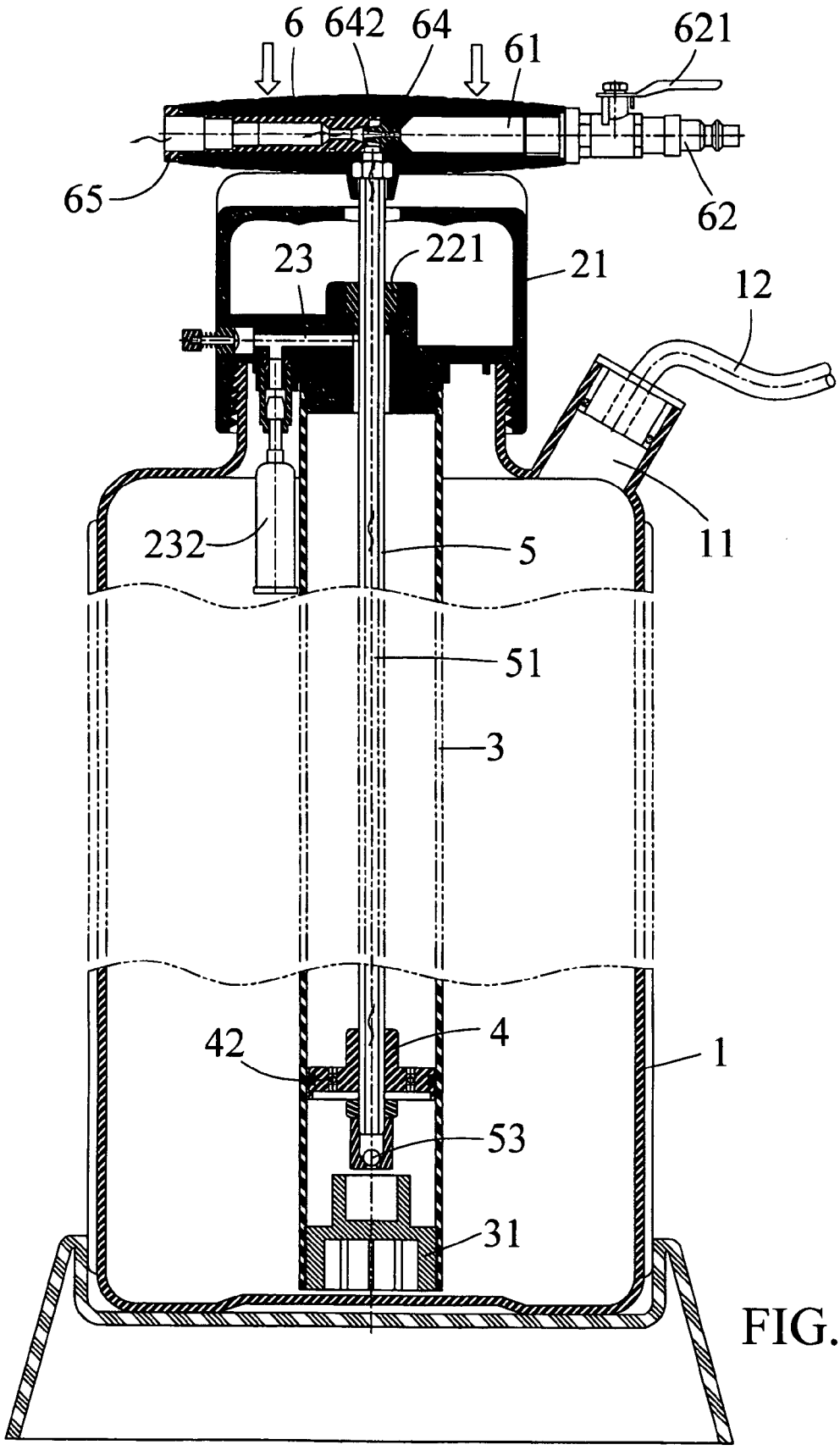
FIG. 6 is a schematic operational view of the liquid pumping device as shown in FIG. 2.
Figure 7:
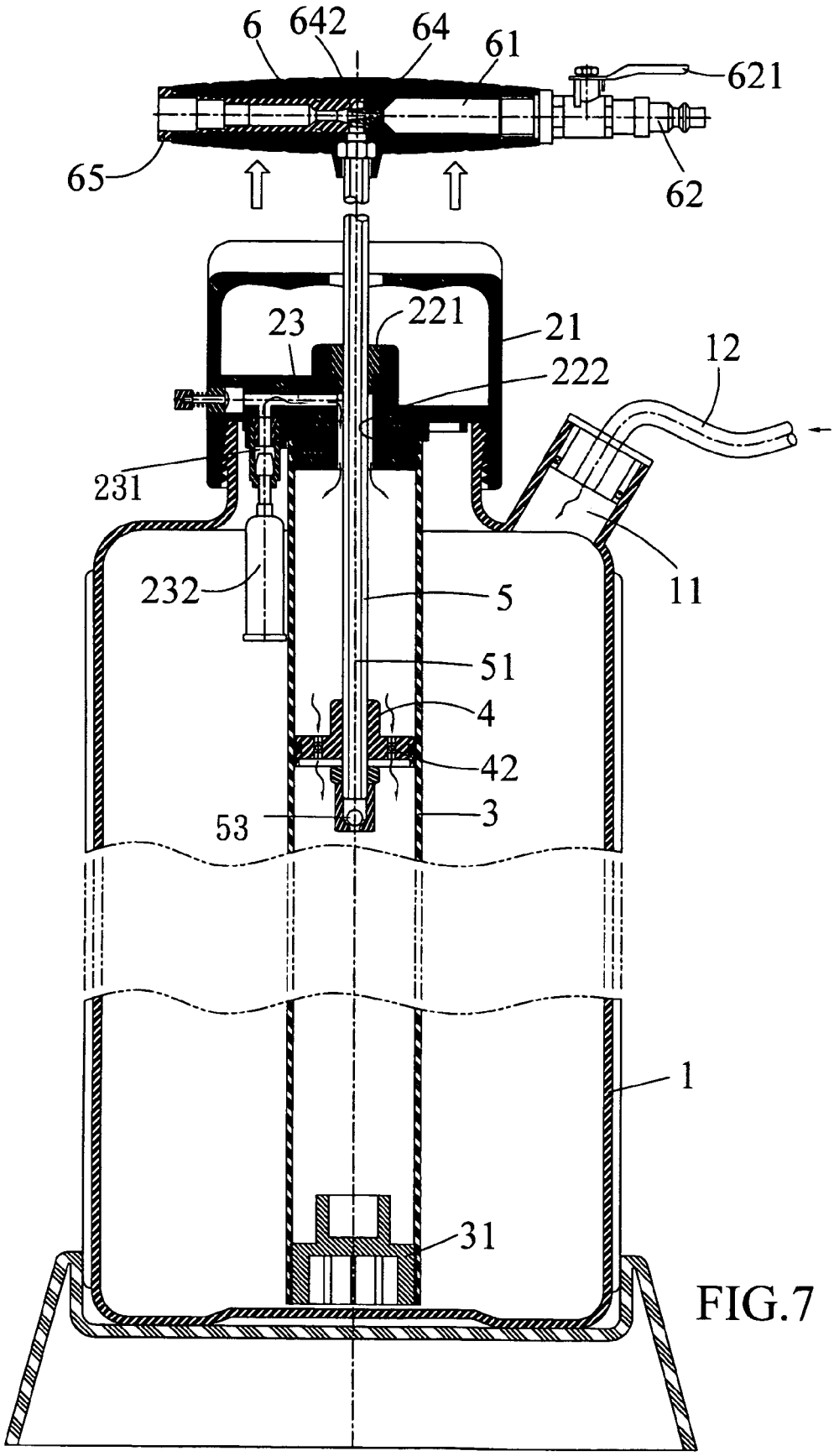
FIG. 7 is a schematic operational view of the liquid pumping device as shown in FIG. 6.

Alternatively, referring to FIGS. 6–7 with reference to FIGS. 1–4, when the operation lever 6 is pushed downward as shown in FIG. 6, the conducting rod 5 and the piston 4 are moved downward to push the air in the lower portion of the cylinder 3 to flow upward through the oneway valve 53 of the conducting rod 5 into the conducting hole 51 of the conducting rod 5. Then, the air is drained outward from the air channel 61 of the operation lever 6. When the operation lever 6 is pushed upward as shown in FIG. 7, the conducting rod 5 and the piston 4 are moved upward to push the air in the upper portion of the cylinder 3 to flow downward through the oneway valves 42 of the piston 4 into the lower portion of the cylinder 3. At this time, the air contained in the barrel 1 also flows through the through hole 231, the conducting groove 23 and the conducting channel 222 of the cover 2 into the upper portion of the cylinder 3. The above-mentioned procedures are repeated successively to evacuate the inside of the barrel 1, thereby forming a suction force in the inside of the barrel 1 to suck the liquid from the suction pipe 12 into the inside of the barrel 1 rapidly.

Accordingly, the liquid pumping device is operated automatically by the power source 7 to suck the liquid from the suction pipe 12 into the inside of the barrel 1 rapidly. In addition, the liquid pumping device is operated manually by the operation lever 6 to suck the liquid from the suction pipe 12 into the inside of the barrel 1 rapidly. Further, the liquid pumping device is operated automatically and manually, thereby enhancing the versatility of the liquid pumping device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A liquid pumping device, comprising:

a barrel;

a cylinder mounted in the barrel;

a conducting rod movably mounted in the cylinder and having an upper end protruding outward from the barrel, an inside formed with a conducting hole and a lower end provided with a oneway valve to allow fluid in the cylinder to flow upward into the conducting hole only;

a piston movably mounted in the cylinder and secured on the lower end of the conducting rod to move therewith, the piston having a peripheral wall formed with a plurality of oneway valves to allow fluid in an upper portion of the cylinder to flow downward into a lower portion of the cylinder only; and an operation lever secured on the upper end of the conducting rod and having an inside formed with an air channel, the air channel of the operation lever having a mediate portion formed with a reduced neck provided with a pressure release valve having an inside formed with a valve hole communicating with the air channel of the operation lever and the conducting hole of the conducting rod.

2. The liquid pumping device in accordance with claim 1, wherein the valve hole of the pressure release valve has a dimension smaller than that of the air channel of the operation lever.

3. The liquid pumping device in accordance with claim 1, wherein the valve hole of the pressure release valve has a narrower first end and a wider second portion.

4. The liquid pumping device in accordance with claim 1, further comprising an urging ring mounted between the pressure release valve and the reduced neck of the operation lever.

5. The liquid pumping device in accordance with claim 1, wherein the air channel of the operation lever has a first end provided with an air inlet nozzle and a control switch and a second end provided with a muffler.

6. The liquid pumping device in accordance with claim 1, wherein the piston is formed with a through hole mounted on the lower end of the conducting rod.

7. The liquid pumping device in accordance with claim 6, further comprising a nut screwed onto the lower end of the conducting rod and rested on the piston.

8. The liquid pumping device in accordance with claim 1, further comprising a cover mounted on the top of the barrel and having a first end face formed with a handle formed with a through hole to allow passage of the conducting rod and a second end face formed with a lug inserted into an upper end of the cylinder.

9. The liquid pumping device in accordance with claim 8, wherein the lug of the cover has an inside formed with a conducting channel mounted on the conducting rod and connected to the inside of the cylinder.

10. The liquid pumping device in accordance with claim 9, wherein the cover has a side formed with a conducting groove having a first end connected to the conducting channel of the lug and a second end formed with an insertion recess for mounting a fixing ring, and the liquid pumping device further comprises an operation shaft movably mounted on the fixing ring and having a first end rested on the fixing ring and a second end protruding outward from the fixing ring, an adjusting knob secured on the second end of the operation shaft, and an elastic member mounted on the operation shaft and biased between the fixing ring and the adjusting knob.

11. The liquid pumping device in accordance with claim 10, wherein the conducting groove of the cover has a mediate portion formed with a through hole connected to the inside of the barrel and provided with a float.

12. The liquid pumping device in accordance with claim 8, further comprising a mounting ring mounted between the lug of the cover and the conducting rod.

13. The liquid pumping device in accordance with claim 1, wherein the barrel has a top formed with a suction hole for mounting a suction pipe which is mounted in the suction hole of the barrel by a seal.

14. The liquid pumping device in accordance with claim 1, wherein the sealing ring is mounted on a lower end of the cylinder.

* * * * *